United States Patent [19]

Maillet

[11] 4,223,844

[45] Sep. 23, 1980

[54] BREAKER-CRUSHER MILL WITH PIVOTED HAMMERS

[76] Inventor: Edgard J. Maillet, Domaine de l'Ermitage Ludon Medoc, 33290 Blanquefort, France

[21] Appl. No.: 922,677

[22] Filed: Jul. 7, 1978

[30] Foreign Application Priority Data

Jul. 8, 1977 [FR] France ..... 77 21081

[51] Int. Cl.[3] ..... B02C 13/31

[52] U.S. Cl. ..... 241/33; 241/189 R; 241/285 B

[58] Field of Search ..... 211/33, 37, 88.4, 189 R, 211/189 A, 190, 194, 285 R, 285 B

[56] References Cited

U.S. PATENT DOCUMENTS

| | | | |
|---|---|---|---|
| 1,647,183 | 11/1927 | Leggemann | 241/189 R X |
| 2,171,463 | 8/1939 | Tschnauner | 241/190 |
| 3,659,794 | 5/1972 | Hemesath | 241/189 R |

*Primary Examiner*—Mark Rosenbaum

*Attorney, Agent, or Firm*—Sandler & Greenblum

[57] ABSTRACT

The invention relates to the mechanical fragmentation of solid bodies. The breaker-crusher mill has hammers pivoted on rotors arranged under a grid enveloping a part of their periphery. The heads of the hammers pass through the bars of the grid and the tangential speeds of the rotors at their opposite points are directed upwards. The mill may be used as a grinder (tires, compressed materials, etc.) or as a crusher (cast iron, steel, etc.).

15 Claims, 2 Drawing Figures

BREAKER-CRUSHER MILL WITH PIVOTED HAMMERScl BACKGROUND OF THE INVENTION

1. Field of the Invention

The present invention relates to mechanical fragmentation of solid bodies.

2. Description of the Prior Art

Classical theories of the mechanism of rupture are outmoded today and, whilst awaiting a satisfactory general theory, it is simply possible to affirm that rupture constitutes not only a mechanical process but also a kinetic process and to refer to the more or less empirical results accumulated up to the present.

Fragmentation has very numerous applications and is applied to the most varied of products. According to the results to be achieved (shapes and sizes of fragments) and the resistance to fragmentation of the product concerned (which is the resultant of various mechanical properties of said product: hardness, tenacity, compacity, compression strength, bending strength, impact strength, etc.) which must govern the mode of action of the fragmentation apparatus.

Various fragmentation mills known at present can be classified according to their principal mode of action, namely:

(a) mills operating by crushing (slow compression or compression with impact): jaw crushers, gyratory grinders, falling mass grinders, roller grinders, cylinder crushers, (b) mills operating by shearing: choppers, (c) mills operating by attrition or by attrition and shearing; grinders with millstones, disks, vibrating tanks, (d) mills operating by percussion by projection: rigid hammer crushers and free-fall breakers, (e) mills operating by percussion by breaker bodies: breakers with balls and crushers with pivoted rotary hammers.

The apparatus according to the invention is a crusher with pivoted rotary hammers but its mode of action is such that there is at the same time, percussion by breaking bodies, shearing, percussion by projection and percussion by free-fall.

In traditional articulated hammer crushers, the materials to be fragmented are introduced into a hammer chamber bounded by armour plating, within which rotate at high speed (peripheral speed 20 to 60 m/s) hammers pivoted at the periphery of a rotor with a horizontal shaft. The lower portion of the percussion or hammer chamber is generally constituted by a grid through which the sufficiently reduced fragments are removed. Supply is effected mostly by a chute placed tangentially to the trajectory of the hammers.

In order to increase the yield, crushers including two horizontal rotors rotating in opposite directions are also made the tangential speeds at the closest points of the two rotors being directed downwards and the two grids which respectively envelope the lower portions of the two rotors meeting in the vertical plane of symmetry to form a set of which the profile has the general shape of an $\omega$ and whose central branch capped by a steel bar comes substantially to the level of the axes of the rotors. The chute or feed hopper is then placed in the plane of symmetry, and the structure of the mill is then entirely symmetrical. The yield is improved with respect to that of two separate mills (all things being otherwise equal: diameter of the rotors, speeds, construction and mass of the hammers, etc.) since there are also produced projections from one rotor to the next (hence percussions on pieces of material having a considerable live force) and also percussions between pieces of material.

However, all these mills do not always give satisfaction where materials are concerned with have high tenacity (such as compressed material, tires, etc.) and certainly have drawbacks.

If pivoted hammers are of course replaceable, this remains nonetheless a long operation which can only be undertaken in case of necessity (wear) and not simply to pass from a primary crushing (pre-crushing) to a secondary crushing (from crushed products of which the elements have their largest dimension limited to a certain value).

Increase in the strength of the products to be processed tends to cause choking of the mill and consequently the slowing of the rotors. It is hence necessary to provide excess power for the drive device, whence there is a consumption of energy unnecessary for normal operation.

Finally and especially when there is introduction of an ungrindable body of fairly large dimensions, blocking occurs of the one or more rotors. Certainly these mills are provided with a safety device (generally friction discs for driving the momentum wheel) which avoids breakage or deformation of the members, but it is then necessary to open the cover of the crushing chamber to release the rotor in extracting the lump responsible for the accident. Given the sizes and weight of a cover (the diameter of a rotor varies between 1 and 2.5 m and even more) this becomes a long and consequently laborious operation.

In the same way in the case of accidental stopping (power failure) or of voluntary stopping, the rotor can not be restarted under load. It is necessary to open the chamber and to free at least partially the path of the hammers.

The breaker-crusher according to the invention does not have any of the above-mentioned drawbacks. In addition, as has been stated, putting the various types of crushing into operation with the exception of compressive crushing and attrition, there is a higher yield.

GENERAL DESCRIPTION OF THE INVENTION

The breaker-crusher mill according to the invention is characterized in that the tangential velocities of the rotors at their opposite points are directed upwards and the crushing chamber is cut in its height into two parts by a grid formed of parallel bars situated in planes perpendicular to the axes of the rotors and arranged above said rotors so that the end of each of the hammers passes between two neighboring bars over a portion of its path, whilst shock plates or plating or reinforcements are arranged on the upper wall of the crushing chamber, the chute opening laterally into the portion of the crushing chamber situated above the grid on one of the surfaces of the mill perpendicular to the axes of the rotors, called front surfaces.

Thus, the products to be crushed arriving through the feed chute fall onto the grid and are hammered by the hammers which have struck them from below throwing them against one another and against the shock lining of the upper wall whence they fall back onto the grid in free-fall. All possible modes of percussion are thus brought into play. In addition when the end of each hammer, after having reached the portion of its path situated above the grid, starts to be engaged between two bars, it again strikes the fragments which have fallen back to this point and cooperates with said bar to exert a shearing force on these fragments.

The pieces of material which are sufficiently fragmented pass through the bars and the grid and fall onto the bottom of the mill (or onto the loading surface of a take-up device which may be continuous or not). During this fall from the grid the fragments are again struck and projected against one another by the hammers. Thus beneath the grid a secondary hammering is carried out.

In the case of an unbreakable body, it is clear that the hammers which have struck it will be obliged to be withdrawn but said body resting on the grid cannot become a blockage for the rotors.

Preferably, the grid is provided with lateral arms passing through the lateral walls of the mill through vertical slots and it is supported by a set of hydraulic jacks which permit it to be brought from the above-mentioned operating position to an upper position in which it is arranged above the paths of the ends of the hammers. This arrangement enables automatic control to be provided for the jacks constituted by an electro-valve servocoupled to an amperemetric relay connected to the drive motors of the rotors so as to obtain the lifting of the grid as soon as the power absorbed by the rotors reaches a predetermined maximum value. It is then possible to load the mill continuously, without fear of overloads or blocking and, in addition, it is possible to start the mill even if it is loaded.

Advantageously, a gate of which the opening and closing manipulation can be remote-controlled, for example by means of a double-acting jack, provided on each of the lateral walls of the mill, the lower edge of the opening being situated substantially at the level of the lateral edge of the grid when the latter is in the upper position, so as to permit the automatic ejection by projection in the course of operation and without stopping the rotors, of the pieces retained by the grid. This arrangement enables unbreakable bodies to be removed after manual interference. It is also possible to operate such a manoeuvre regularly after a given crushing time of a predetermined load to remove the most resistant fragments and thus to carry out on the heterogenous pieces a separation between the products having different crushing resistances. Of course, the fragments thus ejected can be recovered for subsequent crushing.

Whatever the embodiment adopted, the apparatus which has just been defined has a vertical plane of symmetry parallel to the axes of the rotors. Although this may imply that a reduction in yield is accepted, it must be understood that the invention extends to a breaker-crusher including a single rotor and whose construction is identical with that of the halves of the above-mentioned mill cut through its plane of symmetry.

BRIEF DESCRIPTION OF THE DRAWINGS

The invention will be better understood on reading the description which follows with reference to the drawings, in which.

Figure 1:
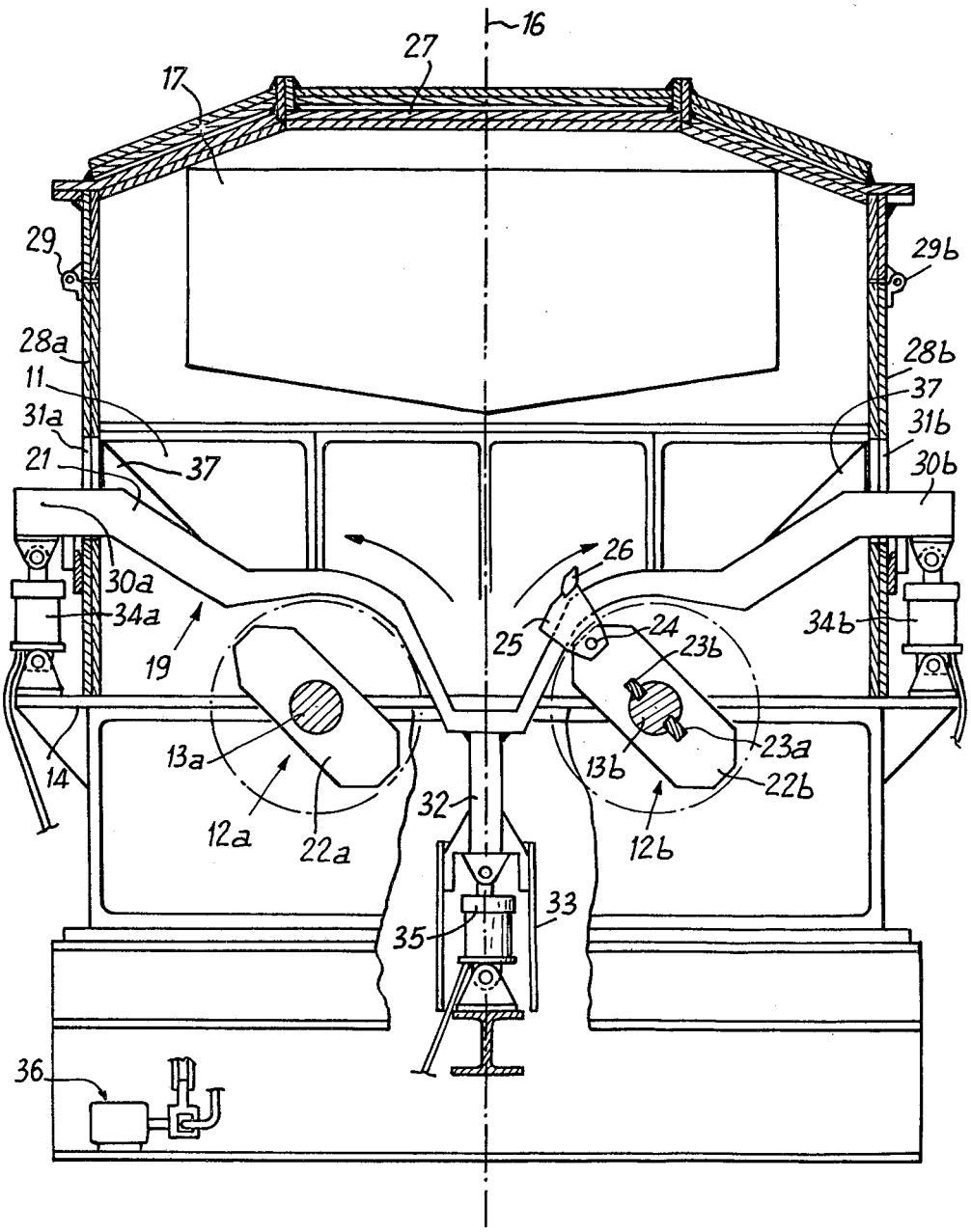
FIG. 1 is a front elevation of a mill according to the invention, with a portion torn away and in partial section.

For greater clarity certain members or details of members do not appear on either of the figures. Thus in FIG. 2, the lifting jacks for the grid and the support plates with their hammers are not shown and the grid is indicated only by the lateral ends of the bars. In the same way, in FIG. 1, one of the rotors includes only one support plate and the other a support plate provided with a hammer at only one of its ends.

DESCRIPTION OF A PREFERRED EMBODIMENT

In the drawing, a breaker-crusher mill resting on a base 10 of metal girders includes a crushing chamber 11 within which rotate in opposite directions, two rotors 12*a* and 12*b* whose shafts 13*a* and 13*b* are parallel and situated in the same horizontal plane 14. They are rotated substantially at the same speed by respective pulleys (15 for the rotor 12*a*) actuated by belts through electric motors (not shown). In the vicinity of the vertical plane of symmetry 16 parallel to the axes of the rotors the tangential velocities of the rotors are directed upwards. Of course, with each rotor is associated a momentum wheel or fly-wheel (not shown).

The crushing chamber is fed by a chute 17 opening laterally on one, 18, of the surfaces of said chamber perpendicular to the shafts of the rotors and called front surfaces.

The chamber 11 is cut in its height into two portions by a grid 19 formed of parallel bars situated respectively in planes perpendicular to the axes of the rotors. In the example shown, there are nine bars, that is to say, eight bars 20 distributed symmetrically on both sides of the central bar 21.

Each rotor 12*a*, 12*b* is constituted by eight support plates such as 22*a*, 22*b* perpendicular to the shaft 13*a*, 13*b* of the corresponding rotor and keyed onto the shaft, as shown at 23*a*, 23*b* for the plate 22*b* on the shaft 13*b*. These plates are offset angularly by 90° from one another throughout the length of the shaft concerned. At each end of each of the support plates is pivoted freely around an axle 24, a hammer 25 (as shown at one of the ends of the plate 22*b*).

Figure 2:
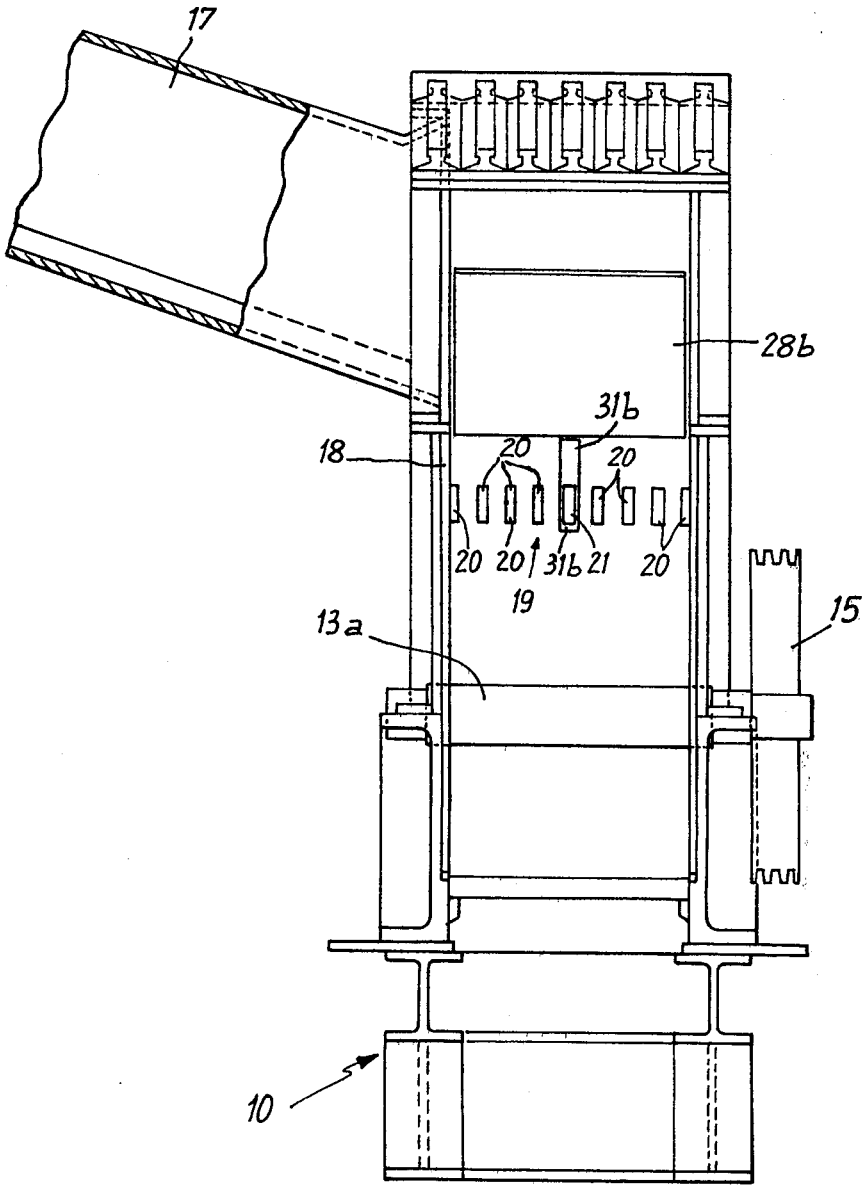
FIG. 2 is a side view, the lateral wall being assumed removed with partial section of the chute.

The grid 19 envelopes for each rotor the part of the ends of the support plate substantially from the intersection of the planes 14 and 16 up to the highest point of this path and then is directed rising again towards the lateral wall of the crushing chamber. The separation of the bars of the grid 19, the position of the support plates on the shaft of the rotor and the thickness of the hammers 25 are such that each hammer can pass between two neighboring bars. Thus, on each turn of the rotor, each hammer is engaged between two bars and its head emerges above the grid over about a quarter of its path, as shown in FIG. 1 for the hammer 25.

The mode of action of the hammers on the products to be crushed has been clearly explained above and it will only be added that the percussion surface of the head is advantageously equiped with a steel point fastened thereto which can be replaced independently of the hammer. The form of this point can vary according to the nature and tenacity of the materials to be processed.

As has been stated, the pieces of material to be crushed are struck by the hammers from below and projected upwards. Hence it is particularly the upper wall 27 of the crushing chamber which must be reinforced to constitute in known manner an armour plating or be lined with impact plates.

Over each of the lateral surfaces (parallel to the axes of the rotors) of the crushing chamber is arranged a gate 28*a*, 28*b* with a horizontal hinge 29*a*, 29*b* and opening outwards. Gussets 37 fixed on the grid 19 form an inclined ramp extending to the level of the lower edge of the gate. The maneuver of opening and closing these gates can be remote-controlled in known manner, for example by double-acting jacks (not shown). When these gates are open, the fragments retained by the grid and projected by the hammers are ejected outside of the crushing chamber. Thus, it is possible without stopping the rotors, either to remove the finally unbreakable fragments, or to exercise a selection between the products of different resistances.

The central bar 21 of the grid 19 is extended on each side in a horizontal arm 30*a*, 30*b* which passes through the corresponding lateral wall through a vertical slot 31*a*, 31*b* arranged in the fed wall substantially at the level of the gate 28*a*, 28*b*. In the vertical plane 16 of symmetry, the grid is provided with two feet such as that 32 seen in FIG. 1, engaged slideably in guides 33.

The grid 19 rests through its arms 30*a*, 30*b* and its feet 32 on four hydraulic jacks namely two lateral 34*a*, 34*b* and two central such as 35, supplied in parallel by hydraulic unit 36. The unit 36 includes an amperemetric regulator comprising an electrowave controlled by an amperemetric relay connected to the drive motors of the rotors so as to cause the lifting of the grid as soon as the power absorbed reaches a predetermined value. Of course, the manipulation of the jacks can also be manually controlled. The return of the fluid is effected through a valve calibrated so as to attain slow descent of the grid. The grid can hence occupy a low position such as that shown in FIG. 1 or a high position in which it is above the paths of the heads of the hammers.

As has been stated, not only the grid retains the unbreakable blocks or pieces which hence cannot block the rotors, but again when the proportion of very resistant pieces increases to the point of requiring too great a force from the rotors, the grid is lifted enabling the rotors to resume their full speed and consequently the hammers their full power, before redescending slowly to again subject the pieces of material to percussion and so on. The mill can hence be loaded continuously. In addition, the mill may be started after having manually actuated the lifting of the grid.

Such a mill may be used as a grinder (tires, compressed materials, etc.) or as a breaker (cast iron, steel, etc.).

A mill including only a single rotor and having a structure identical with that of a half of the breaker-crusher which has just been described cut through its vertical plane 16 of symmetry, is not outside of the scope of the present invention.

I claim:

1. A breaker-crusher mill comprising:

(a) a chute;

(b) a crushing chamber fed laterally by said chute, said crushing chamber comprising a reinforced upper wall and two lateral walls, each of said lateral walls comprising a gate adapted to be remotely controlled, said gate being arranged to cover an opening having a lower edge;

(c) two rotors arranged in said crushing chamber, each of said rotors comprising freely pivoting hammers mounted on the periphery of each of said rotors, said hammers being arranged such that the corresponding hammers on each of said rotors face each other as said rotors are rotated;

(d) means for rotating each of said rotors in opposite directions whereby said corresponding hammers are moved in an upward direction as said corresponding hammers face one another;

(e) a grid comprising a plurality of bars, said bars being arranged in planes perpendicular to the axes of said rotors and arranged above said rotors whereby the ends of each of said hammers passes between two adjacent bars over a portion of their trajectory; and (f) reinforcement means for reinforcing said upper wall of said crushing chamber;

and wherein said chute opens laterally into the section of said crushing chamber situated above said grid and wherein said grid is adapted to be raised from its normal operating position, the lower edge of said opening being situated substantially at the level to which said grid may be raised so as to make possible the automatic ejection of fragments retained by the grid by the contained operation of said rotors.

2. The breaker-crusher as defined by claim 1 further comprising a double acting jack for controlling each of said gates.

3. A breaker-crusher mill comprising:

(a) a chute;

(b) a crushing chamber fed laterally by said chute, said crushing chamber comprising a reinforced upper wall;

(c) two rotors arranged in said crushing chamber, each of said rotors comprising freely pivoting hammers mounted on the periphery of each of said rotors, said hammers being arranged such that the corresponding hammers on each of said rotors face each other as said rotors are rotated;

(d) means for rotating each of said rotors in opposite directions whereby said corresponding hammers are moved in an upward direction as said corresponding hammers face one another;

(e) a grid comprising a plurality of bars, said bars being arranged in planes perpendicular to the axes of said rotors and arranged above said rotors whereby the ends of each of said hammers passes between two adjacent bars over a portion of their trajectory; and (f) reinforcement means for reinforcing said upper wall of said crushing chamber;

and wherein said chute opens laterally into the section said crushing chamber situated above said grid, and wherein said chamber comprises two lateral walls and said grid is connected to extend between each of said walls, said grid comprising at least one lateral arm extending through a vertical slot in each of said lateral walls, each of said lateral arms being supported by a hydraulic jack adapted to raise said grid from its operating position to a position in which said bars are located above the trajectories of said hammers.

4. The breaker-crusher as defined by claim 3 wherein said grid is adapted to be raised from its normal operating position, and each of said lateral walls comprises a gate adapted to be remotely controlled, said gate being arranged to cover an opening having a lower edge, the lower edge of said opening being situated substantially at the level to which said grid may be raised so as to make possible the automatic ejection of fragments retained by the grid by the continued operation of said rotors.

5. The breaker-crusher as defined by claim 3 wherein said said rotors are driven by drive motors and wherein said hydraulic jacks comprise a hydraulic circuit comprising a manual and an automatic control, said automatic control comprising an electrovalve servocoupled to an amperemetric relay, said relay being connected to said drive motors of each of said rotors whereby said grid is raised by said jacks when the power absorbed by said rotors reaches a predetermined maximum value.

6. The breaker-crusher as defined by claim 5 wherein said grid is adapted to be raised from its normal operating position, and each of said lateral walls comprises a gate adapted to be remotely controlled, said gate being arranged to cover an opening having a lower edge, the lower edge of said opening being situated substantially at the level to which said grid may be raised so as to make possible the automatic ejection of fragments retained by the grid by the continued operation of said rotors.

7. A breaker-crusher mill comprising:

(a) a chute;

(b) a crushing chamber fed laterally by said chute, said crushing chamber comprising a reinforced upper wall;

(c) two rotors arranged in said crushing chamber, each of said rotors comprising freely pivoting hammers mounted on the periphery of each of said rotors, said hammers being arranged such that the corresponding hammers on each of said rotors face each other as said rotors are rotated;

(d) means for rotating each of said rotors in opposite directions whereby said corresponding hammers are moved in an upward direction as said corresponding hammers face one another;

(e) a grid comprising a plurality of bars, said bars being arranged in planes perpendicular to the axes of said rotors and arranged above said rotors whereby the ends of each of said hammers passes between two adjacent bars over a portion of their trajectory; and (f) reinforcement means for reinforcing said upper wall of said crushing chamber;

and wherein said chute opens laterally into the section of said crushing chamber situated above said said grid; and wherein said chamber comprises two lateral walls on each side of a vertical plane of symmetry extending between the rotors and wherein each of said bars of said grid is in the shape of a curve parallel to the trajectory outline by each of said rotors as it is rotated, from a point extending between said vertical planes of symmetry and at the level of the shaft of said rotor to the highest point of said trajectory, said grid then rising to a point located on the corresponding lateral wall of said mill, and further wherein said grid comprises at least one lateral arm extending through a vertical slot in the corresponding lateral wall, each of said lateral arms being supported by a hydraulic jack adapted to raise said grid from its operating position to a position in which said bars are located above the trajectories of said hammers.

9. The breaker-crusher as defined by claim 8 wherein said grid is adapted to be raised from its normal operating position, and each of said lateral walls comprising a gate adapted to be remotely controlled, said gate being arranged to cover an opening having a lower edge, the lower edge of said opening being situated substantially at the level to which said grid may be raised so as to make possible the automatic ejection of fragments retained by the grid by the continued operation of said rotors.

10. The breaker-crusher as defined by claim 8 wherein said said rotors are driven by drive motors and wherein said hydraulic jacks comprise a hydaulic circuit comprising a manual and an automatic control, said automatic control comprising an electovalve servocoupled to an amperemetric relay, said relay being connected to said drive motors of each of said rotors whereby said grid is raised by said jacks when the power absorbed by said rotors reaches a predetermined maximum value.

11. The breaker-crusher as defined by claim 10 wherein said grid is adapted to be raised from its normal operating position, and each of said lateral walls comprises a gate adapted to be remotely controlled, said gate being arranged to cover an opening having a lower edge, the lower edge of said opening being situated substantially at the level to which said grid may be raised so as to make possible the automatic ejection of fragments retained by the grid by the continued operation of said rotors.

12. A breaker-crusher mill comprising:

(a) a chute;

(b) a crushing chamber fed by said chute, said crushing chamber comprising an upper wall;

(c) two rotors arranged in said crushing chamber, each of said rotors comprising freely pivoting hammers mounted on the periphery of each of said rotors, said hammers being arranged such that the corresponding hammers on each of said rotors face each other as said rotors are rotated;

(d) means for rotating each of said rotors in opposite directions whereby said corresponding hammers are moved in an upward direction as said corresponding hammers face one another;

(e) a grid comprising a plurality of bars, said bars being arranged in planes perpendicular to the axes of said rotors and arranged above said rotors whereby the ends of each of said hammers passes between two adjacent bars over a portion of their trajectory; and (f) reinforcement means for reinforcing said upper wall of said crushing chamber;

and wherein said chute opens laterally into the section of said crushing chamber situated above said said grid; and wherein said chamber comprises two lateral walls on each side of a vertical plane of symmetry extending between the rotors and wherein each of said bars of said grid is in the shape of a curve parallel to the trajectory outline by each of said rotors as it is rotated, from a point extending between said vertical planes of symmetry and at the level of the shaft of said rotor to the highest point of said trajectory, said grid then rising to a point located on the corresponding lateral wall of said mill, and further wherein said grid comprises at least one lateral arm extending through a vertical slot in the corresponding lateral wall, each of said lateral arms being supported by a hydraulic jack adapted to raise said grid from its operating position to a position in which said bars are located above the trajectories of said hammers.

9. The breaker-crusher as defined by claim 8 wherein said grid is adapted to be raised from its normal operating position, and each of said lateral walls comprising a gate adapted to be remotely controlled, said gate being arranged to cover an opening having a lower edge, the lower edge of said opening being situated substantially at the level to which said grid may be raised so as to make possible the automatic ejection of fragments retained by the grid by the continued operation of said rotors.

10. The breaker-crusher as defined by claim 8 wherein said said rotors are driven by drive motors and wherein said hydraulic jacks comprise a hydaulic circuit comprising a manual and an automatic control, said automatic control comprising an electovalve servocoupled to an amperemetric relay, said relay being connected to said drive motors of each of said rotors whereby said grid is raised by said jacks when the power absorbed by said rotors reaches a predetermined maximum value.

11. The breaker-crusher as defined by claim 10 wherein said grid is adapted to be raised from its normal operating position, and each of said lateral walls comprises a gate adapted to be remotely controlled, said gate being arranged to cover an opening having a lower edge, the lower edge of said opening being situated substantially at the level to which said grid may be raised so as to make possible the automatic ejection of fragments retained by the grid by the continued operation of said rotors.

12. A breaker-crusher mill comprising:

(a) a chute;

(b) a crushing chamber fed by said chute, said crushing chamber comprising an upper wall;

(c) a rotor arranged in said crushing chamber, said rotor comprising freely pivoting hammers mounted on the periphery of said rotor;

(d) means for rotating said rotor in a direction such that said rotor is adapted to propel fragments upwardly towards said upper wall as said rotor rotates;

(e) a grid comprising a plurality of bars, said bars being arranged perpendicular to the axis of said rotor and arranged above said rotor whereby the ends of each of said hammers passes between two adjacent bars over a portion of their trajectory; and (f) reinforcement means for reinforcing said upper wall of said crushing chamber;

and wherein said grid is adapted to be raised from its normal operating position, and said chamber comprises two lateral walls, each of said lateral walls comprising a gate adapted to be remotely controlled, said gate being arranged to cover an opening having a lower edge, the lower edge of said opening being situated substantially at the level to which said grid may be raised so as to make possible the automatic ejection of fragments retained by the grid by the continued operation of said rotors.

13. The breaker-crusher as defined by claim 12 further comprising a double acting jack for controlling each of said gates.

14. A breaker-crusher mill comprising:

(a) a chute;

(b) a crushing chamber fed by said chute, said crushing chamber comprising an upper wall;

(c) a rotor arranged in said crushing chamber, said rotor comprising freely pivoting hammers mounted on the periphery of said rotor;

(d) means for rotating said rotor in a direction such that said rotor is adapted to propel fragments upwardly towards said upper wall as said rotor rotates;

(e) a grid comprising a plurality of bars, said bars being arranged perpendicular to the axis of said rotor and arranged above said rotor whereby the ends of each of said hammers passes between two adjacent bars over a portion of their trajectory; and (f) reinforcement means for reinforcing said upper wall of said crushing chamber;

and wherein the chamber comprises two lateral walls and said grid comprises at least one lateral arm extending through a vertical slot in the corresponding lateral wall, each of said lateral arms being supported by a hydraulic jack adapted to raise the grid from its operating position to a position in which the bars are located above the trajectories of said hammers.

15. The breaker-crusher as defined by claim 14 wherein said rotor is driven by a drive motor and wherein said hydraulic jacks comprise a hydraulic circuit comprising a manual and an automatic control, said automatic control comprising an electrovalve servocoupled to an amperemetric relay, said relay being connected to said drive motors of said rotor whereby said grid is raised by said jacks when the power absorbed by said rotors reaches a predetermined maximum valve.

* * * * *

UNITED STATES PATENT AND TRADEMARK OFFICE

CERTIFICATE OF CORRECTION

PATENT NO. : 4,223,844

DATED : September 23, 1980

INVENTOR(S) : Edgard J. Maillet

It is certified that error appears in the above—identified patent and that said Letters Patent is hereby corrected as shown below:

In column 1, lines 2 and 3, "HAMMERScl BACKGROUND OF THE" should read ---HAMMERS

BACKGROUND OF THE INVENTION---.

Column 2, line 7, "with" should read ---which---.

Column 3, line 43, "manoeuvre" should read ---maneuver---.

Column 5, line 16, "fed" should read ---feed---.

Column 6, line 68, "said said" should read ---said---.

Column 7, lines 46-47 (claim 7), "outlines" should read ---outlined---.

Column 7, lines 54-55 (claim 7), "remotedly" should read ---remotely---.

UNITED STATES PATENT AND TRADEMARK OFFICE

CERTIFICATE OF CORRECTION

PATENT NO. : 4,223,844

DATED : September 23, 1980

INVENTOR(S) : Edgard J. Maillet

It is certified that error appears in the above—identified patent and that said Letters Patent is hereby corrected as shown below:

Column 8, line 17 (claim 8), "said said" should read ---said---.

Column 8, line 22 (claim 8), "outline" should read ---outlined---.

Column 8, line 37 (claim 9), "comprising" should read ---comprises---.

Column 8, line 46 (claim 10), "said said" should read ---said---.

Column 8, line 49 (claim 10), "electovalve" should read ---electrovalve---.

Signed and Sealed this

*Tenth* Day of *March 1981*

[SEAL]

*Attest:*

RENE D. TEGTMEYER

*Attesting Officer*

*Acting Commissioner of Patents and Trademarks*